US005190367A

United States Patent [19]

Aoki

[11] Patent Number: 5,190,367

[45] Date of Patent: Mar. 2, 1993

[54] LUMINOUS DISPLAY BOARD

[75] Inventor: Norio Aoki, Tokyo, Japan

[73] Assignee: High Performance Chemical Co., Ltd., Tokyo, Japan

[21] Appl. No.: 784,080

[22] Filed: Oct. 30, 1991

Related U.S. Application Data

[63] Continuation of Ser. No. 628,518, Dec. 17, 1990, abandoned.

[51] Int. Cl.[5] ..... F21K 2/06

[52] U.S. Cl. ..... 362/34; 362/253; 362/806; 362/812; 206/461; 229/92.8; 40/124.1

[58] Field of Search ..... 362/34, 84, 253, 806, 362/812, 101; 206/45.31, 461; 229/92.8; 40/124.1

[56] References Cited

U.S. PATENT DOCUMENTS

| | | | |
|---|---|---|---|
| 1,143,729 | 6/1915 | Schmidt | 229/92.8 |
| 2,160,724 | 5/1939 | Fletcher | 40/124.1 |
| 2,361,354 | 10/1944 | Regester | 40/124.1 |
| 3,539,794 | 11/1970 | Rauhut et al. | 362/34 |
| 3,756,398 | 9/1973 | Green et al. | 206/461 |
| 4,117,532 | 9/1978 | Arbib | 362/806 |
| 4,559,583 | 12/1985 | Ku | 362/806 |
| 4,814,949 | 3/1989 | Elliott | 362/34 |
| 4,951,404 | 8/1990 | Lithwick | 229/92.8 |
| 4,975,809 | 12/1990 | Ku | 362/253 |

*Primary Examiner*—Ira S. Lazarus
*Assistant Examiner*—Y. Quach
*Attorney, Agent, or Firm*—Armstrong, Westerman, Hattori, McLeland & Naughton

[57] ABSTRACT

A flat type luminous member that illuminates characters or pictures drawn on a greeting card, a card attached to a bouquet, a display or the like from the back side thereof. The luminous member includes a flexible light-transmitting container having at least a glass ampule within the container. The glass ampule and the container are each filled with respective solutions for causing chemical luminescence when the respective solutions are mixed. The container is flat-shaped and has a luminous portion where luminous light emits. The luminous portion has pictures or characters thereon.

5 Claims, 4 Drawing Sheets

LUMINOUS DISPLAY BOARD

This application is a continuation of application Ser. No. 628,518 filed Dec. 17, 1990, now abandoned.

BACKGROUND OF THE INVENTION

1. Field of the Invention

This invention generally relates to a luminous display board, and more particularly to a flat type luminous member that illuminates characters or pictures drawn on a greeting card, a card attached to a bouquet, a display or the like from the back side thereof.

2. Description of the Relevant Art

Luminous members which emit light through chemical luminescence have heretofore been used as illumination sources such as, a flashlight, an emergency light, a float light for fishing or the like. This type of luminous member has a light-transmitting cylindrical flexible plastic receptacle container filled with a solution and a glass ampule. A reactive substance (e.g., an oxalic acid derivative and a fluorescent substance) are filled in the container, and a solution (e.g., hydrogen peroxide, a catalyst or the like) are filled in the glass ampule, sealed therein, and inserted into the flexible plastic container. These substances emit a light by excitation when reacted with each other.

When the luminous member is used to emit light, the above-described flexible container is folded to break the glass ampule inside the container and then shaken in order to mix two kinds of solutions with each other. As a result, the above-mentioned reactive substance and hydrogen peroxide react with each other in order to excite the fluorescent substances so that light is emitted therefrom.

In the western world, including Europe and the United States, it is customary to present greetings on occasions, such as Christmas and birthdays. These types of greetings have recently become widely accepted in Japan.

Furthermore, instead of a "New Year" letter, some Japanese now tend to send a greeting card.

In order to give a good impression to people who receive greeting cards, there are various kinds of cards, for example, a card with various designs, a card which becomes three-dimensional when it is opened or a card which makes a sound when it is opened. Therefore, by using the above-described chemical luminescence, characters or pictures drawn on a greeting card, for Christmas or birthday or a card attached to a bouquet, a display or the like, can be illuminated from the back side thereof in order to stand out and attract attention.

It is also considered to use the above-mentioned chemical luminescence for a display board at night, for example, for use as a guidance board for guests in a funeral or the like.

However, the above-described prior art luminous member has a drawback in that the card or display board is required to be thick because the luminous member itself is cylindrical. Thus, the above-described conventional luminous member is not suitable, especially for a card having an image and for illuminating characters or pictures drawn on the surface from the back side thereof.

Therefore, the luminous member is required to be flat. However, it is not necessary to illuminate all of the surfaces of the card or board, but it is necessary to partially cover the surface of the card or board by a shield in order to illuminate certain parts of the surface. The cost of such a luminous member would be high because the chemical luminescent solution for the portion which is shielded is expensive and is made useless.

If the above-described luminous member is enclosed within a cover which has at least some light-transmitting portion, and is composed of a card or display board, even if it is about the same size as the luminous member in order to avoid a flexible luminous member, the cost will also be high because the chemical luminescence solution for the non-light-transmitting portion is useless.

Therefore, considering the above-described situations, it is an object of the present invention to provide a flat luminous display board which makes use of the chemical luminescence solution for the luminescent portion.

It is noted that a flat shaped luminous display board has another problem; namely, the reaction of an oxalic acid derivative with hydrogen peroxide to excite a fluorescent substance to emit light causes the occurrence of carbon dioxide gas in the container. Therefore, if the flexible plastic container is flat shaped, the front side and the back side of the container becomes swollen due to the enlargement of the bulk of the container in opposite directions from the pressure of the carbon dioxide gas. In other words, the flat shape of the container becomes deformed. When the container is standing up, it will cause the level of chemical luminescent solution to descend to a lower level so that an upper portion of the standing flat shaped display will not emit the light.

If the flexible plastic container is cylindrical, the increased pressure due to chemical reaction will equally push the inner portion of the cylinder, and will cause the cylindrical container to expand slightly. If the flexible plastic container is flat shaped, both sides of the container will expand, then stress will concentrate towards the edge portion of the container which will break the container causing leakage of the solution; especially, in the case where the flat shaped container has a special inlet where glass ampules are used, and a cap thermally sealed to the inlet, the stress due to the increase in the gas pressure will concentrate on the thermally sealed cap portion to destroy the seal. If the thermal sealing is made strong enough to endure the stress, then it will be expensive.

Therefore, considering the above-described problems, it is an object of the present invention to provide a flat luminous display board which can prevent deformation or destruction of the flat shaped container due to increase in the gas pressure due to chemical reaction.

SUMMARY OF THE INVENTION

The luminous display board of the present invention comprises a luminous member, and pictures or characters illuminated by the luminous member.

The luminous member includes a flexible light transmitting container having glass ampules within the container, the glass ampule and the container each being filled with respective solution, for causing chemical luminescence when the respective solutions are mixed, and the container being flat shaped.

The luminous member further has a supporting portion around a luminous portion of the container and connecting portions in a hollow flat space in the container.

With the present invention, it is possible to provide a unique flat display board which utilizes chemical luminescence. A luminous member which is flat-shaped, like a card, can emit light from its luminous portion to illuminate pictures or characters on the luminous member itself or on the sheet attached to the display cover member where the luminous member is enclosed.

The luminous member having connection portions between the front side board and the backside of the container prevents the breaking or deforming by gas pressure when chemical reaction occurs.

The luminous member, having a supporting portion around the luminous portion integrally formed within the container, provides the luminous portion of the luminous member in alignment with the display portion, wherein pictures or characters are illuminated since the luminous member is tightly inserted into the receiving portion of the display cover member for fitting the size of the luminous member to the receiving portion of the display cover member.

These and other features of the invention will be understood upon reading of the following description along with the drawings.

DETAILED DESCRIPTION OF THE PREFERRED EMBODIMENTS

The embodiments of the present invention will now be described in detail with reference to the drawings.

Figure 1:
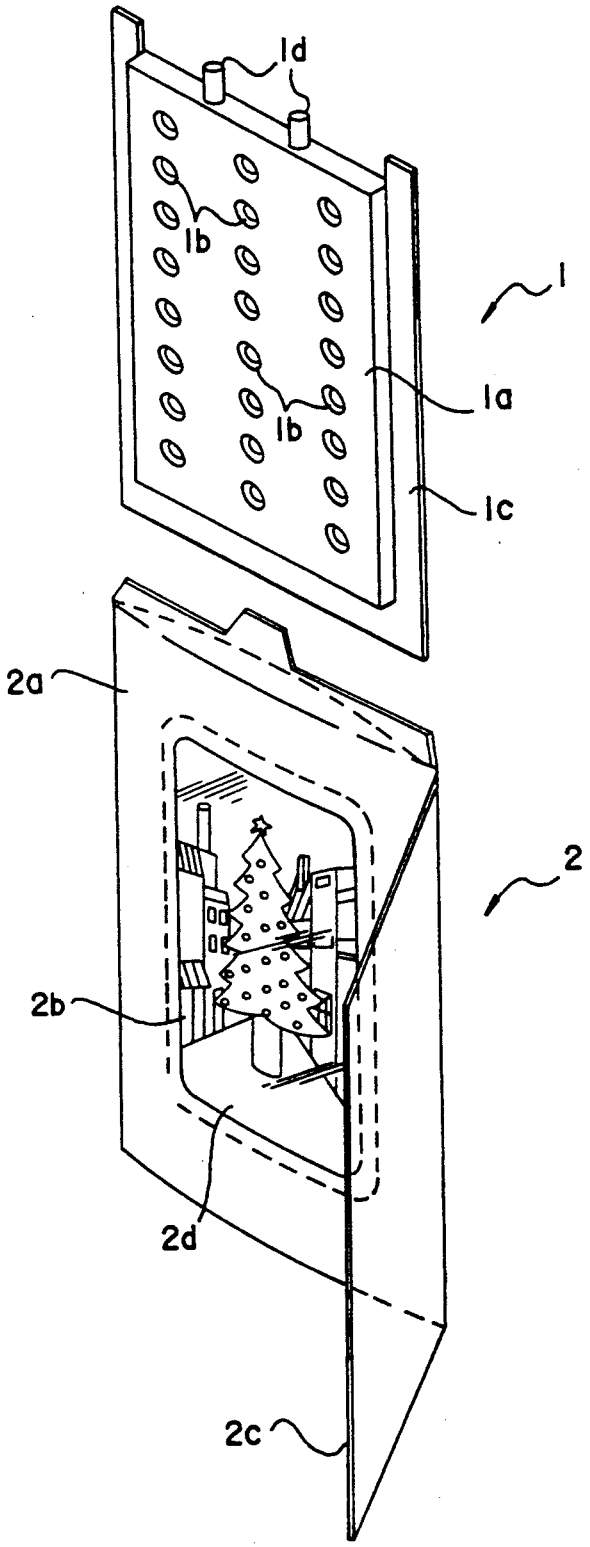
FIG. 1 is a perspective exploded view of a luminous member and a display board of the present invention.

As shown in FIG. 1, the luminous member 1 is inserted into the receiving portion 2*a* of the covering member 2, and pictures or characters drawn on the display portion 2*b* are illuminated from the back side by the luminous member 1 when used as a Christmas card.

Figure 2:
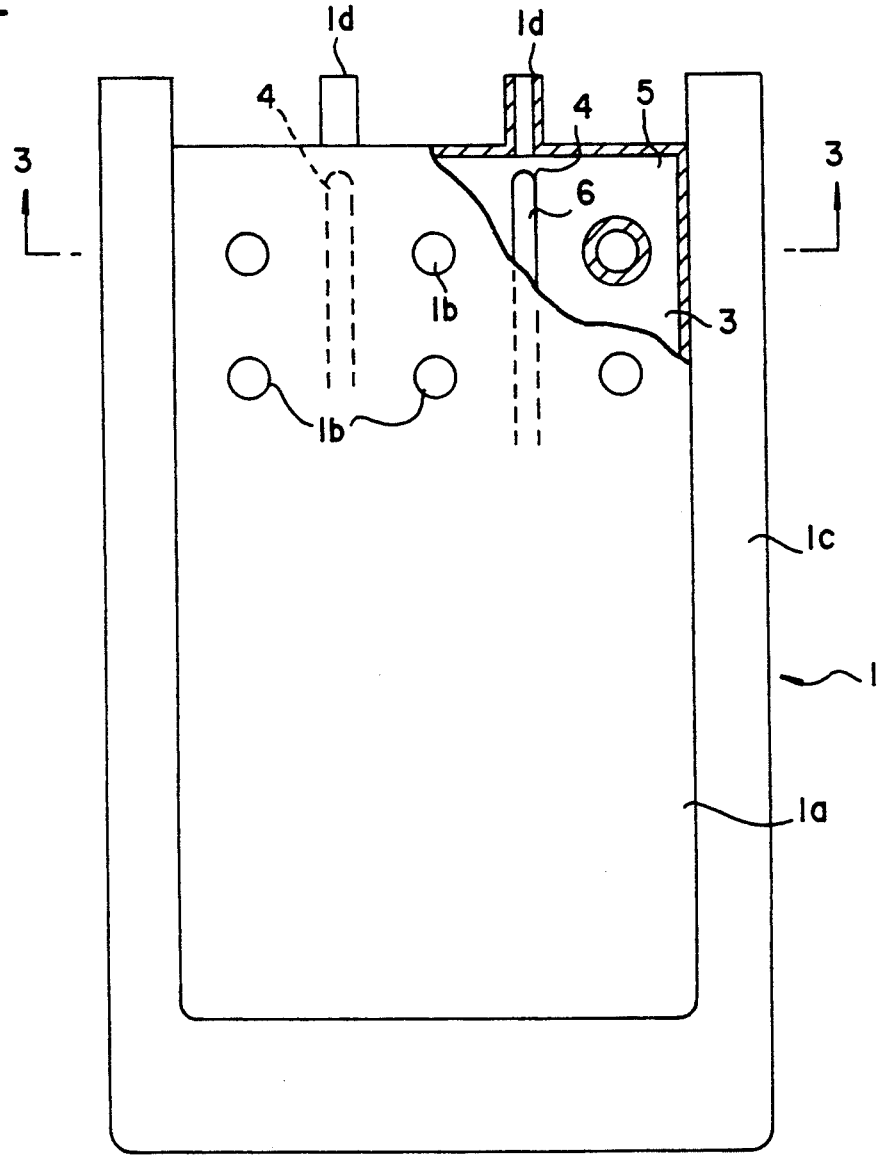
FIG. 2 is a plan partial cut-away sectional view of an embodiment of the luminous member of the present invention.
Figure 3:
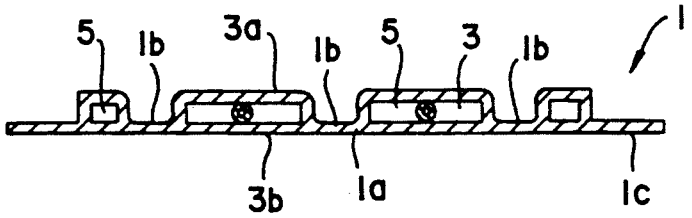
FIG. 3 is a cross-sectional view taken along the luminous member taken in the direction of arrows 3—3 of FIG. 2.

As shown in FIGS. 2 and 3, the luminous member 1 generally includes a glass ampule 4, inserted into the inner portion of the container 1*a*, a liquid solution "A" (an ingredient which will be explained later) 5 contained within the inside portion of the container 1*a*, a liquid solution "B" (an ingredient which will be explained later) 6 contained within the glass ampule 4.

The container 1*a* is made of flexible material and formed with a flat shape with a hollow space 3 and a plurality of connecting portions 1*b* for connecting the front side 3*a* to the back side 3*b*, by blow formation, integrally formed with the hollow space 3.

As shown in FIG. 3, connecting portion 1*b* is made cylindrical by pushing the front side 3*a* of hollow space 3 toward the back side 3*b*. There is a supporting portion 1*c* around the hollow space 3 where the light is emitted. Supporting portion 1*c* aligns the position of the hollow space 3 of the container 1*a* to the display portion 2*b* of the covering member 2. Namely, the supporting portion 1*c* is integrally formed around the hollow space 3 with back side 3*b*, thereby making the size thereof coincide with the receiving portion 2*a* of the covering member 2 in order to align the hollow space 3 to the display portion 2*b*.

Reference number 1*d* is a pipe-like inlet for allowing the solution 5"A" to be poured to the hollow space 3 and to put the glass ampule filled with solution "B"6 into the hollow space 3. Also, the pipe-like inlet is used to inject compressed air to the inside portion of the container 1*a* when it is formed by blow-shaping.

The solution "A" has, as reactive substance bis (2,4,5-trichloro-6-carbobutoxyphenyl oxalate) (with an abbreviation of "TCCPO"), and, as fluorescent substance, 9, 10 - bis(phenylethenil) anthraoene (with an abbreviation of "BPEA"), whereby these are mixed to be dissolved in the solvent dibutyl phthalate (with an abbreviation "TBAS").

The glass ampule 4 is pipe-like and is filled with solution "B", and it is more fragile than the container 1*a*.

The covering member 2 is made of thick paper, pasteboard or kent paper which has a light-transmitting characteristic, and the covering member 2 consists of a pocket-like receiving portion 2*a* and a cover portion 2*c* which covers the receiving portion 2*a* being folded in two.

The pasteboard which has the receiving portion 2*a* has a display portion 2*b*, formed by punching a hole on one side of the pasteboard. At the display portion 2*b*, a more light-transmitting sheet 2*d* than the pasteboard (e.g., transparent or half-transparent thin paper, non-woven fabric, plastic sheet) is attached wherein pictures or characters are drawn on the sheet 2*d*.

In order to manufacture the flat luminous member of this embodiment, the container 1*a* is formed by blow-formation; i.e., by using a metal mold which has cylindrical bumps on one side for making connection portion 1*b* in the container 1*a* inserting material resin which is pipe-like pushed out into the metal mold; blowing compressed air to expand the material resin; sticking the material resin fast to the inside portion of the metal mold; hardening the material resin; then, taking it away from the metal mold).

Next, solution "B" is poured into the glass ampule through the mouth thereof and a gas burner is used to melt the mouth of the glass ampule for closing; it; solution "B" is then enclosed in the glass ampule.

Thereafter, solution "A" is poured into the container 1*a* from the inlet 1*d*. The solution "B" enclosed glass ampule is placed into the container from the inlet 1*d*, and the inlet 1*d* is melted shut. Then, the assembly of the luminous member 1, shown in FIG. 1 through FIG. 3, is completed.

In order to use the luminous member 1, the luminous member 1 is set into receiving portion 2*a* of the card covering member 2. By the means of the supporting portion 1*l*, hollow space portion 3 is aligned to the position of the display portion 2*b*.

In order to emit the light from the luminous member 1, the container 1*a* is folded to break the glass ampule 4 in the container 1*a*, and the container 1*a* is shaken so as to mix the solution "A" and the solution "B" inside of the container. The luminescent reaction then occurs so as to emit the light from the back side of the display portion sheet 2*d* of the covering member 2, and to illuminate the pictures drawn on the sheet 2*d* which are to be highlighted. When luminescent reaction causes the occurrence of carbon dioxide gas to increase the pressure inside of the container 1*a*, a plurality of the connection portions 1*b* tightly connect from the front board 3*a* to the back board 3*b*, and the front board 3*a* and the back board 3*b* are not deformed.

This embodiment of the flat luminous member 1 has a container 1*a* integrally formed by blow-formation which has inlets 1*d*, wherein solution "A" and solution "B" enclosed in glass ampule 4 are poured. Accordingly, it is not necessary to provide any special inlet for solution "A" and glass ampule to be poured thereinto. In order words, after pouring solution "A" and putting glass ampule 4 into the container 1*a*, it is only necessary to close the inlet 1*d* by thermal melting, and it is not necessary to prepare any special cap or spend time to fix the special cap to seal the inlet.

Even if the inside pressure of the container 1*a* is increased due to the presence of carbon dioxide gas by the chemical reaction, the container 1*a* is not fragile because the container is integrally formed by blow-formation.

The metal mold for blow-formation is less expensive than the metal mold for injection-formation; thus, by way of the blow-formation, it is possible to reduce cost to manufacture the container 1*a*.

Furthermore, there are many connecting portions 1*b* between the front board 3*a* and the back board 3*b*, and stress caused by dioxide gas pressure increase is dispersed to many connecting portions 1*b* and the end portion of the container. Thus, space between the front board 3*a* and the back board 3*b* does not expand to concentrate the stress to the end portion of the containers so as to break the container 1*a* at the end portion. Also, hollow space 3 between the front board 3*a* and the back board 3*b* does not expand to descend the mixed solution "A" and "B" at a comparative level; thus, it is possible to prevent the non-transmission of light from an upper portion of the container 1*a* when it is used.

In comparing the embodiment of the present invention to the prior art cylindrical luminous member discussed in the background of the invention, since solution convection in the hollow space is difficult to occur, reaction speed becomes slow; thus, it is possible to emit the light from the luminous member of the present invention for a long time.

The container 1*a* has supporting portion 1*c* integral thereto in order to fit the size of the covering member 2 with the receiving portion 2*a*; thus, it is possible to prevent the container 1*a* from shaking when inside the covering member 2.

The container 1*a* includes the hollow space 3 in alignment with the display portion 2*b* of the covering member 2 so as not to waste luminous solution "A" and "B" to reduce the amount of solution "A", "B" and their costs.

With this embodiment of the present invention, as shown in FIG. 1, the container 1*a* is inserted into the covering member 2, and it is used as a Christmas card. However, it is possible to change a transparent or half transparent sheet 2*d* on which pictures or characters are drawn for any purpose (e.g., for a birthday card) card attached to a bouquet.

Figure 4:
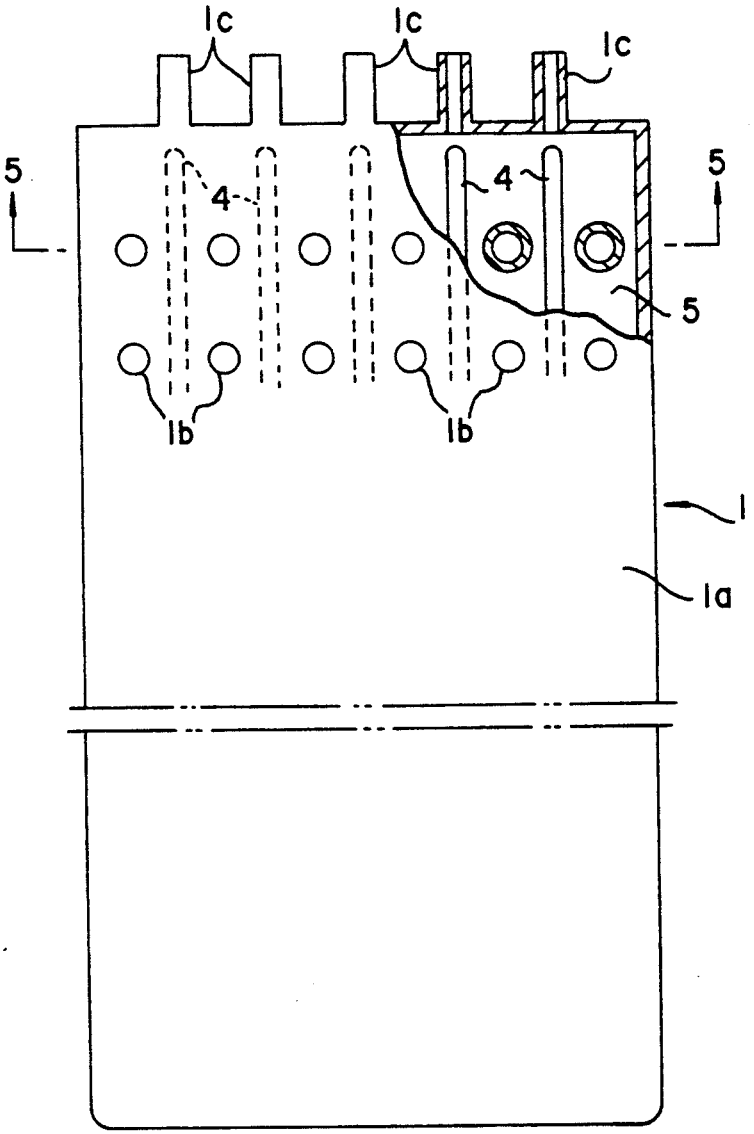
FIG. 4 is a plan partial cut-away sectional view of an alternate embodiment of the luminous member of the present invention.
Figure 5:
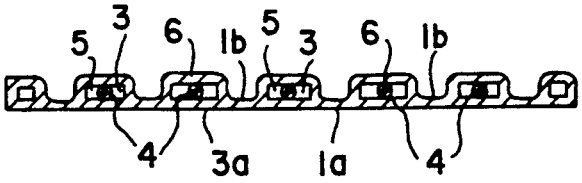
FIG. 5 is a cross-sectional view through the luminous member taken in the direction of arrows 5—5 of FIG. 4.

FIG. 4 and FIG. 5 show alternative embodiments of a luminous member which are different only in the numbers of glass ampules 4, connecting portions 1*b* and inlets 1*c* from the embodiment shown in FIG. 2 and FIG. 3.

Figure 6:
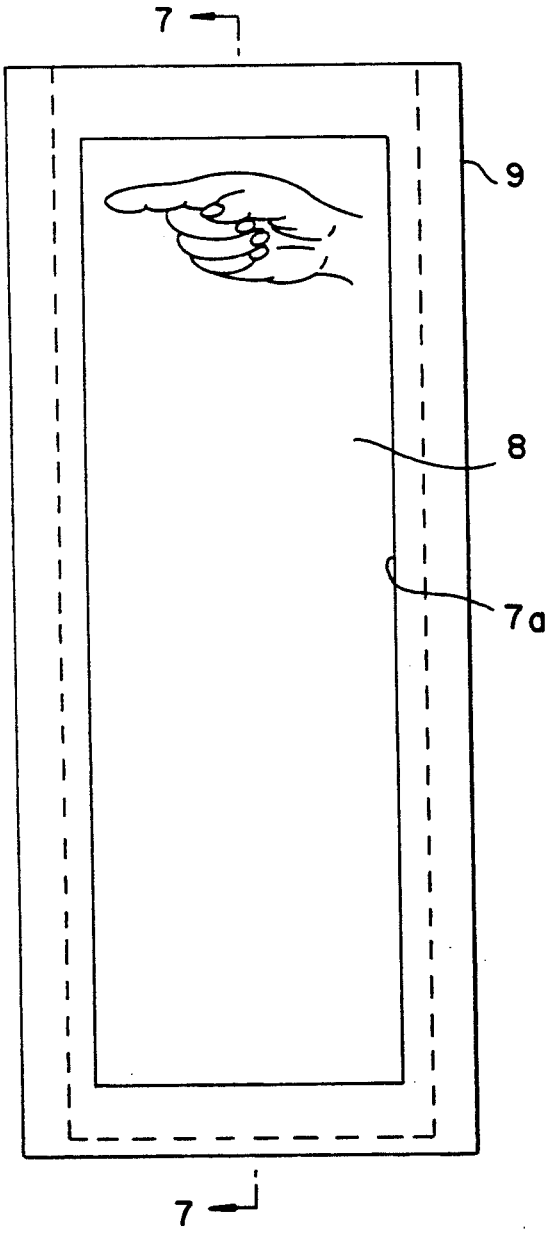
FIG. 6 is a plan view of an alternative embodiment of the display board of the present invention.
Figure 7:
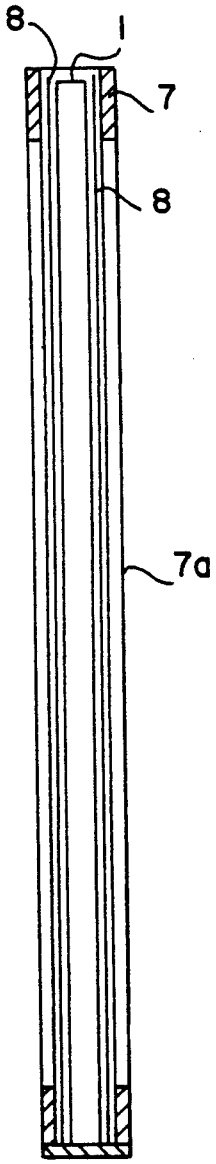
FIG. 7 is a cross-sectional view through the display board taken in the direction of arrows 7—7 of FIG. 6.

Another alternative embodiment of the present invention is shown in FIG. 6 and FIG. 7. The flat luminous member 1 is enclosed in a covering member 7, and it is used as a display board for a funeral ceremony, wherein the date and time of the funeral ceremony are written and displayed as a guide for quests.

As to this display board, a flat luminous member 1 is enclosed in a frame-like covering member 7 having an open area 7*a*, wherein transparent or half-transparent thin paper, plastic sheet or acryl board on which characters or pictures for the funeral ceremony are written, is inserted from above as a display portion 8 and illuminated by the luminous member 1.

With this luminous display board, it is possible to easily change the display sheet; thus, it is easy to change the characters or pictures on the display; and even in the dark at night, it is possible to display the information clearly. Also, the flat luminous member 1 is enclosed in the covering member 7; thus, the flat luminous member 1 is physically protected.

This embodiment shows that a flat luminous member 1 is enclosed in the covering member 7 as a display board. Also, it is possible to easily display information (such as, characters or pictures) written on the flat luminous member even at night.

Instead of a frame-like covering member 7, a bag-like vessel enclosing the luminous member or a sheet attached on the surface of the luminous member is also available.

In the embodiment shown in FIG. 6 and FIG. 7, the container of the luminous member is larger than the display portion 8 of the covering member 7 having a supporting portion without a hollow space around the container 1*a*, and it is thus possible not to use luminescent solution in parts of the container where the frame of the covering member 7 covers uselessly. The reduction in cost is thus possible.

The above-described embodiments are related to Christmas card and a display board for a funeral ceremony. However, various other kinds of displays are available for this invention.

In the embodiment shown in FIG. 2 through FIG. 5, connection portions 1*b* are circle-shaped, although any shape is available. It is noted however that using a circle-shaped connection portion makes the light come uniformly transmitted, and it is possible not to have dark areas at connecting portions or to lose luminescence efficiency.

In preferred embodiments, hollow space 3, container 1*a* covering portion 7, and display portion 8 are all rectangular-shaped. However, any shape, such as round-shaped, heart-shaped, is also available.

Of course, the use of the luminous member is not limited, such uses include the luminous member of this invention being used, for example, as a fish luring light, a marker which marks a person in the dark, etc. Thus, with this invention, it is possible to provide a novel and non-obvious luminous member and display which is card-like flat, thin, and conspicuous with the use of chemical luminescence, and is also economical and easy to use.

While preferred embodiments of this invention have been described and illustrated, it should be understood that modifications are possible without departing from the spirit and scope of this invention as defined by the appended claims.

What is claimed is:

1. A luminous member, comprising:

a flexible flat shaped light-transmitting container having a hollow flat internal space with a peripheral sealed edge forming a support framing said hollow flat internal space and a plurality of nonrupturing connecting portion which are formed so as to connect a front side to a back side of the hollow flat internal space within said sealed edge support frame to maintain said flat shape of said container, a glass ampule within the container, the glass ampule and the container each being filled with respective solutions, for causing chemical luminescence when the respective solutions are mixed.

2. A luminous member as set forth in claim 1, wherein said hollow flat internal space and said sealed edge support frame are integrally formed.

3. A luminous member as set forth in claim 1, wherein the container is formed by blow-shaping.

4. A display board, comprising:

a flexible light-transmitting container having at least a glass ampule within the container, the glass ampule and the container each being filled with respective solutions, for causing chemical luminescence when the respective solutions are mixed, and the container being flat-shaped and having a luminous portion where luminous light emits which includes a hollow flat internal space with a peripheral sealed edge forming a support framing said hollow flat internal space and a plurality of non-rupturing connecting portions which are formed so as to connect a front side to a back side of the hollow flat internal space within said sealed edge support frame to maintain said flat shape, and wherein the luminous portion has pictures or characters thereon.

5. A display board, comprising:

a luminous member including a flexible flat shaped light-transmitting container having a hollow flat internal luminous portion with a peripheral sealed edge forming a support framing said hollow flat internal luminous portion and a plurality of non-rupturing connecting portions which are formed so as to connect a front side to a back side of the hollow flat internal luminous portion sealed edge support within said frame to maintain said flat shape of said container, a glass ampule within the container, the glass ampule and the container each being filled with respective solutions, for causing chemical luminescence when the respective solutions are mixed, a covering member including a receiving portion wherein the luminous member is inserted, and at least partially transparent display portion having pictures or characters thereon, wherein the sealed edge support frame of said luminous member is configured for engagement within said receiving portion to align said luminous portion with said at least partially transparent display portion to illuminate the characters or pictures on the at least partially transparent display portion.

* * * * *